US009364734B1

(12) United States Patent
Dixon, Jr.

(10) Patent No.: US 9,364,734 B1
(45) Date of Patent: Jun. 14, 2016

(54) TRAINING BAT APPARATUS FOR PRACTICING BAT HANDLING SKILLS

(71) Applicant: Nicholas E. Dixon, Jr., Albertville, AL (US)

(72) Inventor: Nicholas E. Dixon, Jr., Albertville, AL (US)

( * ) Notice: Subject to any disclaimer, the term of this patent is extended or adjusted under 35 U.S.C. 154(b) by 0 days.

(21) Appl. No.: 14/121,716

(22) Filed: Oct. 10, 2014

Related U.S. Application Data

(60) Provisional application No. 61/961,697, filed on Oct. 21, 2013.

(51) Int. Cl.

| | |
|---|---|
| ***A63B 69/00*** | (2006.01) |
| ***A63B 59/00*** | (2015.01) |
| *A63B 15/00* | (2006.01) |
| *A63B 59/06* | (2006.01) |
| *A63B 69/38* | (2006.01) |

(52) U.S. Cl.
CPC ..... *A63B 69/0002* (2013.01); *A63B 15/00* (2013.01); *A63B 59/06* (2013.01); *A63B 69/38* (2013.01); *A63B 2069/0008* (2013.01)

(58) Field of Classification Search
CPC .. A63B 69/0002; A63B 15/00; A63B 15/005; A63B 24/0062; A63B 59/50; A63B 60/06
USPC ..... 473/422, 457, 458, 464, 446, 564, 568, 473/516, 538, 206
See application file for complete search history.

(56) References Cited

U.S. PATENT DOCUMENTS

| | | | | |
|---|---|---|---|---|
| 2,591,523 A * | 4/1952 | Dick | B62J 23/00 473/206 |
| 2,780,464 A * | 2/1957 | Ashley | A63B 53/14 473/206 |
| 4,423,868 A * | 1/1984 | Younts | A63B 59/50 473/564 |
| 4,634,121 A * | 1/1987 | Sasaki | A63B 15/00 473/457 |
| 5,215,307 A * | 6/1993 | Huffman | A63B 15/00 473/256 |
| 6,406,387 B1 * | 6/2002 | Ryan | A63B 69/0002 473/422 |
| 6,482,113 B1 * | 11/2002 | Finn | A63B 59/50 473/206 |

(Continued)

FOREIGN PATENT DOCUMENTS

GB 2193649 A * 2/1988 ..... A63B 59/025

*Primary Examiner* — Mitra Aryanpour
(74) *Attorney, Agent, or Firm* — John R. Flanagan

(57) ABSTRACT

A training bat apparatus includes a shaft and audible and visual swing quality indicators on the shaft. The audible indicator includes a sound-producing body affixed to a barrel portion of the shaft, and an impact-producing body movably mounted along the shaft so as to strike the sound-producing body and produce a noticeable sound in response to the training bat apparatus undergoing a dry swing relative to a pitched ball. The visual indicator is provided in a radial position along a longitudinal side, and relative to a longitudinal axis, of the shaft for enabling placement of a batter's hands in a given proper tandem grip about a handgrip portion of the shaft. Provision of these indicators and their functioning enable the batter to undergo effective dry batting training using the training bat apparatus in conjunction with a pitcher and catcher undergoing respective pitching and receiving training in a bullpen session.

22 Claims, 9 Drawing Sheets

(56) References Cited

U.S. PATENT DOCUMENTS 7,297,078 B2 * 11/2007 Libonati ..... A63B 15/005 473/422
2002/0055402 A1 * 5/2002 Ciesar ..... A63B 15/00 473/457
2003/0013563 A1 * 1/2003 Ryan ..... A63B 69/0002 473/457
2003/0144089 A1 * 7/2003 Ryan ..... A63B 69/0002 473/457
2004/0048696 A1 * 3/2004 Ciesar ..... A63B 69/0002 473/457
2004/0138012 A1 * 7/2004 Tyler ..... A63B 71/14 473/446
2005/0153797 A1 * 7/2005 Nutter ..... A63B 15/005 473/457
2005/0261075 A1 * 11/2005 Pullaro ..... A63B 15/00 473/256
2010/0087279 A1 * 4/2010 Jennings ..... A63B 71/14 473/516
2010/0234144 A1 * 9/2010 Sutlovich ..... A63B 69/0002 473/457
2010/0248867 A1 * 9/2010 Tande ..... A63B 15/005 473/457
2010/0311525 A1 * 12/2010 Cornford ..... A63B 59/55 473/457
2014/0080639 A1 * 3/2014 Weston ..... A63B 15/00 473/457
2015/0111671 A1 * 4/2015 Blankenship ..... A63B 15/00 473/457

* cited by examiner

TRAINING BAT APPARATUS FOR PRACTICING BAT HANDLING SKILLS

This patent application claims the benefit of U.S. provisional application No. 61/961,697 filed Oct. 21, 2013. The disclosure of said provisional application is hereby incorporated herein by reference thereto.

BACKGROUND OF THE INVENTION

1. Field of the Invention

The present invention generally relates to bullpen sessions and, more particularly, is concerned with a training bat apparatus for practicing bat handling skills during bullpen sessions in which a pitcher and catcher are practicing pitching and receiving skills.

2. Description of the Prior Art

To become "game ready" it is imperative that batters face live pitching as much as possible prior to games. The more "game stress" at-bats a player gets in practice, the better prepared that player will be when he or she starts game play batting.

Traditional batting practice is held using a pitching machine or a live pitcher. The live pitcher is typically not one from the active pitching roster of the team. The pitcher will usually be either a coach or another person capable of maintaining adequate ball control to deliver each pitch within the batter's strike zone so that the batter will be able hit every pitch. A catcher is typically absent during traditional batting practice. Thus, the way traditional batting practice is held does not really simulate "game stress" at-bats.

The inventor herein has perceived a pressing need to overcome the drawbacks of traditional batting practice and find a way to increase the opportunity to hold a batting practice that more closely simulates the conditions of "game stress" at-bats.

SUMMARY OF THE INVENTION

The present invention provides a training bat apparatus designed to overcome the above-described drawbacks and satisfy the aforementioned need. Underlying the present invention is an insight originated by the inventor herein, namely, that every year teams waste the opportunity to get multi-thousands of bonus "game stress" at-bats that could be obtained by participation of batters in traditional bullpen pitching sessions. The training (or workout) bat apparatus of the present invention allows teams to tap into an untouched reservoir of thousands of daily live bullpen pitching sessions. The training bat apparatus is a simple practice tool that is used to simulate live batting while a pitcher throws to a catcher. The training bat apparatus is not used to hit balls; instead due to its shortened length the batter is allows to take non-contact or dry, full speed practice swings or to take non-contact or dry bunts at a live pitched ball without making contact.

To become stronger, more accurate, confident, to learn pitch control, and to reach their maximum potential, each pitcher on a team has to throw several times a week to a catcher in what are called bullpen pitching sessions. These sessions traditionally included a pitcher throwing to a catcher, squatted down, with a coach observing, coaching, and giving instructional tips. It is normal for a pitcher to throw from 30 to 75 or even more pitches during a daily bullpen workout. When multiplied times 5 or 6 or more pitchers on a team, one can quickly realize that thousands of pitches are thrown weekly. With the provision of the training bat apparatus of the present invention, these thousands of pitches during bullpen sessions also become batting practice simulation sessions for the team's batters. Batters during batting practice need to swing at pitches under two important conditions: (1) knowing what pitch is coming; and (2) not knowing what pitch is coming. These two conditions are easily practiced when batters "dry-swing" during pitching bullpen sessions. The catcher can tell the batter what the next pitch will be or keep the batter in suspense.

In many cases, a team has a dominate pitcher that throws a dominate fastball, curveball or other type pitch. Batters on this pitcher's team can gain valuable visual ball tracking experience and game-like batter-pitcher showdowns, umpired by the catcher, during bullpen pitching sessions by using the training bat apparatus of the present invention to take dry swings to practice hitting different pitch locations, to practice hitting off speed pitches, to practice executing proper swings and timing on situational hitting, and to practice distinguishing between balls and strikes. Batters get a better feel for needed bat speed or swing adjustments just by using the training bat apparatus of the present invention and taking dry swings while this pitcher throws bullpen sessions. On every pitch, the batter uses a "game approach". If the pitch is a strike, the batter uses the correct and proper swing timing to hit the pitch's location. These bullpen batting sessions are not designed to replace regular batting practice, but rather to act as a supplemental source of bonus batting practice swings and "game pressure" practice experiences.

Accordingly, in one aspect of the present invention, a training bat apparatus includes an elongated shaft and an audible swing quality indicator being arranged on the elongated shaft. The elongated shaft has a pair of opposite ends and handgrip and barrel portions disposed in tandem relation to one another along the shaft. The handgrip portion extends from adjacent to one of the opposite ends of the shaft toward the other of the opposite ends thereof. The barrel portion extends from adjacent to the other opposite end of the shaft toward the one opposite end thereof. Unlike a regulation bat, the barrel portion of the training bat apparatus is shorter in length than the handgrip portion so as to configure the training bat apparatus to be used by a batter for taking a non-contact or dry swing at a pitched ball. The audible swing quality indicator is arranged on the elongated shaft so as to produce a noticeable sound in response to the training bat apparatus, when gripped at the handgrip portion of the shaft by a batter, being moved through a dry swing at the pitched ball. By recognizing what the position of the training bat apparatus is during the dry swing, relative to a given position of simulated ball contact with the pitched ball, when the sound is produced, an indication is provided of the relative quality of the dry swing of the batter at the pitched ball in terms of its timing, speed and technique. The provision of the audible swing quality indicator and its functioning on the training bat apparatus enables the batter to undergo effective dry batting training using the training bat apparatus in conjunction with a pitcher and catcher undergoing respective pitching and receiving training in a bullpen session.

In an exemplary embodiment, the audible swing quality indicator may take the form of a sound-producing body and an impact-producing body adapted to strike the sound-producing body. The sound-producing body is affixed to the barrel portion of the elongated shaft at the other opposite end thereof and is configured to produce the noticeable sound, when struck by the impact body. The impact body is movably mounted along the elongated shaft so as to strike the sound-producing body and produce the noticeable sound in response to the training bat apparatus, when gripped at the handgrip portion of the shaft by a batter, being moved through the dry swing at the pitched ball by the batter.

More particularly, the sound-producing body is a bell affixed to the barrel portion of the elongated shaft at the other opposite end thereof and being configured to produce a ringing sound when struck. The elongated shaft has an elongated bore formed therein extending between and open at opposite ends of the shaft such that at least a portion of the bell is exposed to the bore at the other opposite end of the shaft. The impact-producing body is a striker member received within the elongated bore of the elongated shaft so as to be slidably movable within the bore and of sufficient mass to strike the exposed portion of the bell and produce the ringing sound in response to the dry swing of the training bat apparatus by the batter.

In another aspect of the present invention, a training bat apparatus includes the elongated shaft, as described above, and a visual swing quality indicator being arranged on the elongated shaft. The visual swing quality indicator is provided in a given radial position along a longitudinal side, and relative to a longitudinal axis, of the elongated shaft for enabling placement of the hands of a batter in a given proper tandem grip about the handgrip portion of the elongated shaft being in a given proper alignment with the visual swing quality indicator so as to hold the training bat apparatus in a proper pre-pitch launch position at the start of a dry swing of the training bat apparatus at the pitched ball. Such alignment of the grip of the batter's hands with respect to the visual swing quality indicator at the start of the dry swing of the training bat apparatus enables the visual swing quality indicator to represent, in accordance with its angular position relative to the playing field, how well the batter has guided the training bat apparatus along the given proper path of dry swing through the position of simulated ball contact. The provision of the visual swing quality indicator and its functioning enables the batter to undergo effective dry batting training using the training bat apparatus in conjunction with a pitcher and catcher undergoing respective pitching and receiving training in a bullpen session.

In an exemplary embodiment, the visual swing quality indicator may take the form of a grip guard of an arcuate shape and having a pair of opposite ends. The grip guard at its opposite ends is coupled to the elongated shaft so as to retain the grip guard at a fixed radial position relative to the handgrip portion of the shaft and allow the grip guard, extending along and in a spaced relationship to the shaft, to span over at least the handgrip portion of the shaft.

More particularly, one of the opposite ends of the grip guard is fixedly coupled to the one opposite end of the elongated shaft so as to retain the grip guard at a set radial position relative to the handgrip portion of the shaft. The other of the opposite ends of the grip guard has a hole therethrough being configured to allow the elongated shaft to extend through the hole to place the other opposite end of the grip guard at a location between the handgrip and barrel portions of the shaft. This form of the visual swing quality indicator not only serves the purpose of representing the quality of the dry swing, but also of protecting the grip of the batter on the handgrip portion of the training bat apparatus.

In still another aspect of the present invention, a training bat apparatus includes the elongated shaft, as described above, and the audible and visual swing quality indicators, as described above, being arranged on the elongated shaft.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

General Overview

Figure 1:
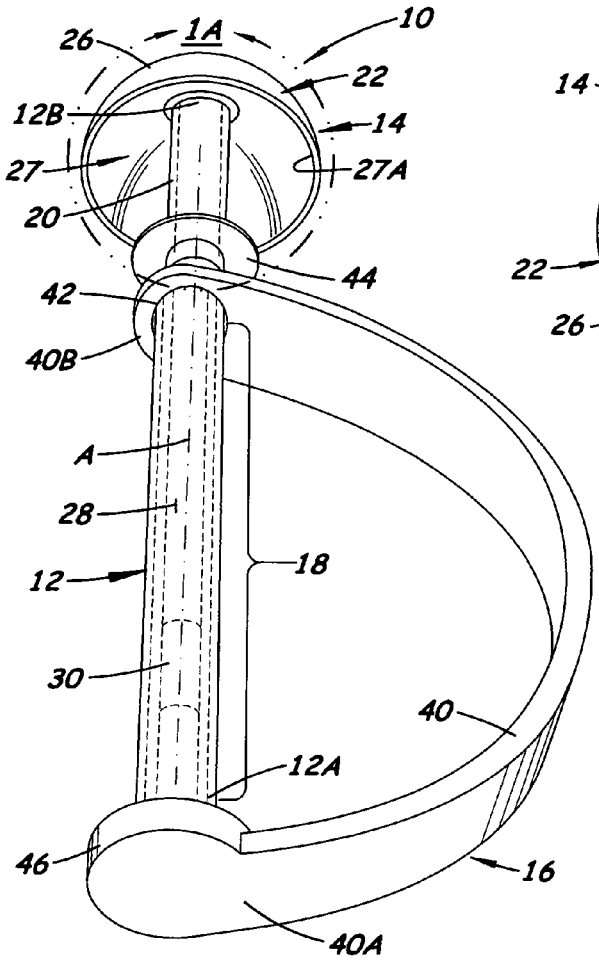
FIG. 1 is a perspective view of an exemplary embodiment of a training bat apparatus having audible and visual swing quality indicators in accordance with the present invention.
Figure 2:
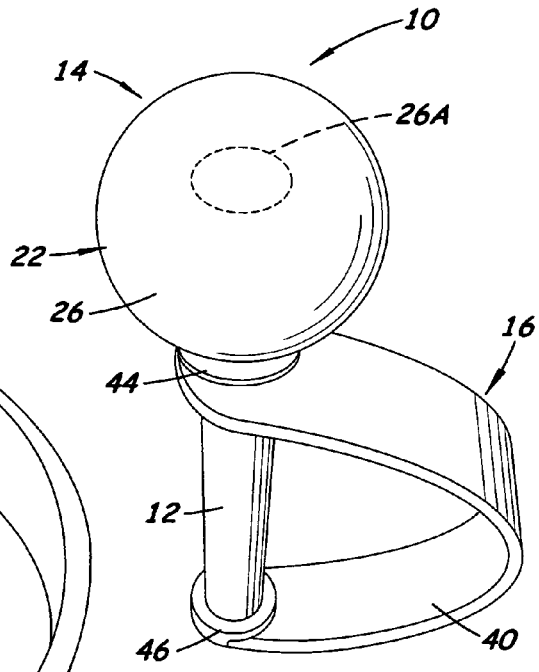
FIG. 2 is another perspective view of the training bat apparatus generally opposite to that of FIG. 1.

Referring to the drawings, and particularly to FIGS. 1, 1A, 2-4, 5A and 5B, there is illustrated an exemplary embodiment of a training bat apparatus, generally designated 10, in accordance with the present invention. The training bat apparatus 10 includes an elongated shaft 12 and audible and visual swing quality indicators 14, 16 being arranged on the elongated shaft 12. The training bat apparatus 10 is designed to take practice swings without contact with a pitched ball. The shortened length of the training bat apparatus 10 (for example, between twelve to fourteen inches, but still at the same weight as a full-length bat) allows the batter to take a full speed swing, with the same feel as with a game bat, at a live pitched ball without making contact.

Figure 3:
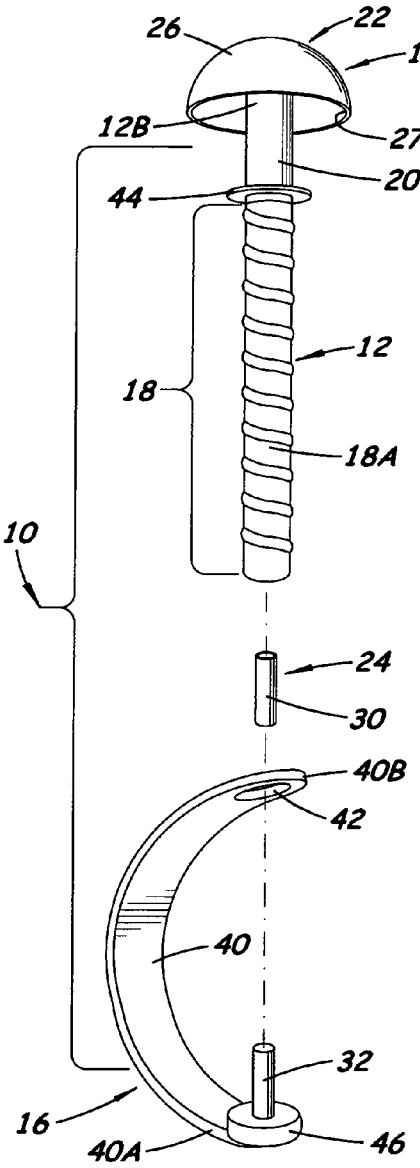
FIG. 3 is an exploded side elevational view of the training bat apparatus showing the components of the audible and visual swing quality indicators.
Figure 5B:
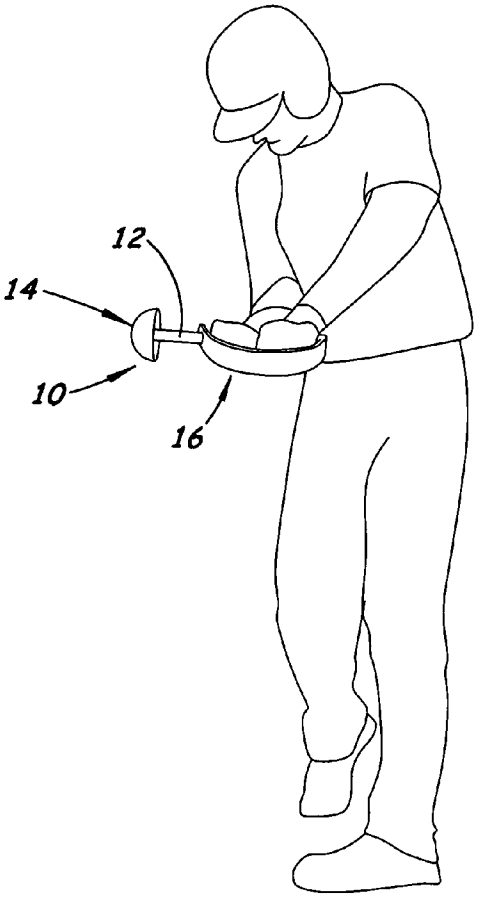
FIG. 5B is a pictorial view of a batter at a position of simulated ball contact during a dry swing of the training bat apparatus at a pitched ball.
Figure 5A:
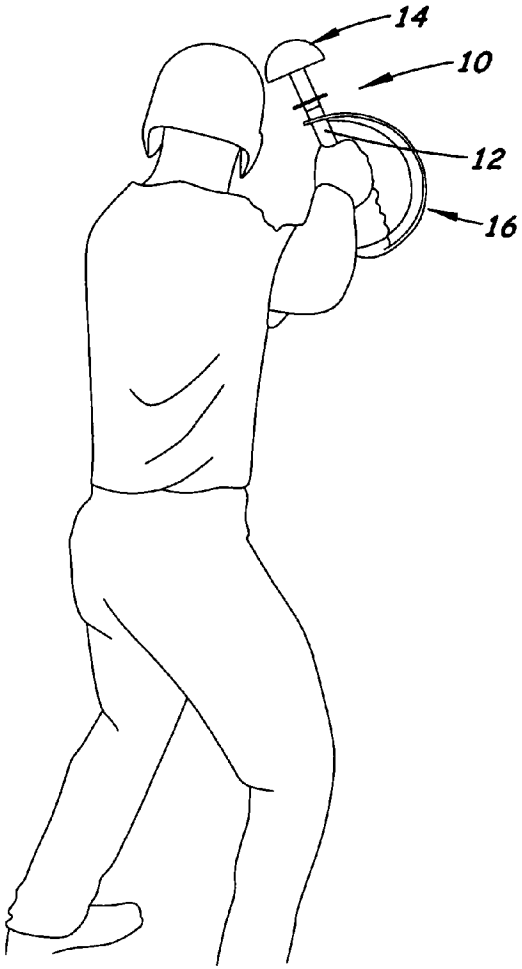
FIG. 5A is a pictorial view of a batter at a proper pre-pitch launch position at the start of a non-contact or dry swing of the training bat apparatus.

The elongated shaft 12 has a pair of opposite ends 12A, 12B and handgrip and barrel portions 18, 20 disposed in tandem relation to one another along the shaft 12. The handgrip portion 18 extends from adjacent to the one opposite end 12A of the shaft 12 toward the other opposite end 12B thereof. The barrel portion 20 extends from adjacent to the other opposite end 12B of the shaft 12 toward the one opposite end 12A thereof. Unlike in a regulation or game bat, the barrel portion 20 of the training bat apparatus 10 is shorter in length than the handgrip portion 18 so as to configure the training bat apparatus 10 to be used by a batter for taking a non-contact or dry swing at a pitched ball, as seen in FIGS. 5A and 5B. As seen in FIGS. 1 and 3, a regular bat grip 18A is wrapped or applied around the handgrip portion 18 of the training bat apparatus 10. A leather, simulated leather, molded or shrink wrap grip can be used.

Figure 6:
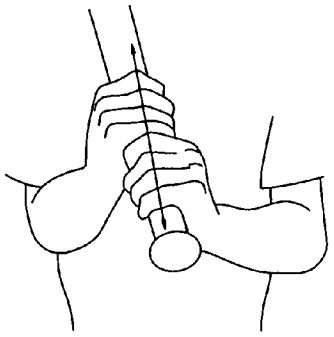
FIG. 6 is a diagrammatic view of the arrangement of the hands of a batter to form a proper tandem grip on a bat.
Figure 7:
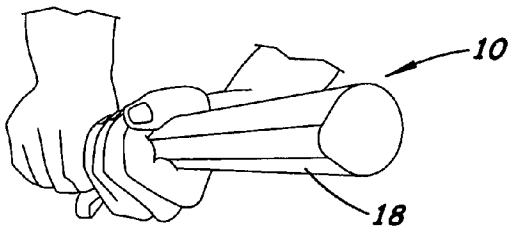
FIG. 7 is a perspective view of one embodiment of a shaft of the training bat apparatus wherein at least its handgrip portion in cross-section has a V or wedge shape.
Figure 8:
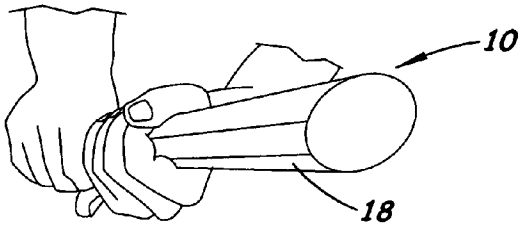
FIG. 8 is a perspective view of another embodiment of the shaft of the training bat apparatus wherein at least its handgrip portion in cross-section has an oval shape.

It is commonly recognized that the arrangement of the hands of a batter to form a proper ("perfect") tandem grip on a bat, such as seen in FIG. 6, should be one that has the "knocking knuckles" of the fingers of both hands generally aligned in a row. At least the handgrip portion 18 of the training bat apparatus 10 in cross-section may be fabricated to have V or wedge shape as shown in FIG. 7 or an oval shape as shown in FIG. 8 to ensure that the batter properly aligns his or her hands to form the proper or correct grip.

The audible swing quality indicator 14 is arranged on the elongated shaft 12 so as to produce a noticeable sound in response to the training bat apparatus 10, when gripped at the handgrip portion 18 of the shaft 12 by a batter, being moved through the dry swing at the pitched ball. By recognizing what the position of the training bat apparatus 10 is during the dry swing, relative to a given position of simulated ball contact with the pitched ball as shown in FIG. 5B, when the sound is produced, an indication is provided of the relative quality of the dry swing of the batter at the pitched ball in terms of its timing, speed and technique. The provision and functioning of the audible swing quality indicator 14 on the shaft 12 of the training bat apparatus 10 enables the batter to undergo effective dry batting training using the training bat apparatus 10 in conjunction with a pitcher and catcher undergoing respective pitching and receiving training in a bullpen session.

The visual swing quality indicator 16 is arranged on the elongated shaft 12 in a given radial position along a longitudinal side, and relative to a longitudinal axis A, of the shaft 12 for enabling placement of the hands of the batter in a given proper tandem grip (see FIG. 6) about the handgrip portion 18 of the shaft 12 being in a given proper alignment with the visual swing quality indicator 16 so as to hold the training bat apparatus 10 in a proper pre-pitch launch position at the start of the dry swing of the training bat apparatus 10 at the pitched ball, as seen in FIG. 5A. Such alignment of the grip of the batter's hands with respect to the visual swing quality indicator 16 at the start of the dry swing of the training bat apparatus 10 enables the visual swing quality indicator 16 to represent, in accordance with its angular position relative to the playing field, how well the batter has guided the training bat apparatus 10 along the given proper path of dry swing through the position of simulated ball contact, as seen in FIG. 5B. The provision and functioning of the visual swing quality indicator 16 on the shaft 12 of the training bat apparatus 10 enables the batter to undergo effective dry batting training using the training bat apparatus 10 in conjunction with the pitcher and catcher undergoing respective pitching and receiving training in the bullpen session.

Both the audible swing quality indicator 14 and the visual swing quality indicator 16 are preferably incorporated in the training bat apparatus 10, as in the exemplary embodiment shown in the drawings. However, it should be understood that either one of the two by itself may be incorporated in the training bat apparatus 10 in accordance with the principles of the present invention.

Audible Swing Quality Indicator

In one exemplary embodiment as illustrated in FIGS. 1, 1A, 2-4, 5A and 5B, the audible swing quality indicator 14 may take the form of a sound-producing body 22 and an impact body 24 adapted to strike the sound-producing body 22. The sound-producing body 22 is affixed to the barrel portion 20 of the elongated shaft 12 at the other opposite end 12B thereof and is configured to produce a noticeable sound, when struck by the impact body 24. The impact body 24 is movably mounted along the elongated shaft 12 so as to strike the sound-producing body 22 and produce the noticeable sound in response to the training bat apparatus 10, when gripped at the handgrip portion 18 of the shaft 12 by a batter, being moved through the dry swing at the pitched ball by the batter.

Figure 1A:
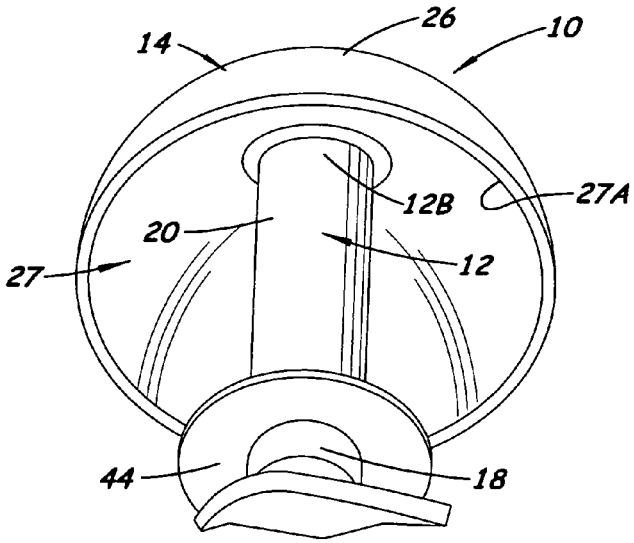
FIG. 1A is an enlarged perspective view of the portion of the audible swing quality indicator of the training bat apparatus bounded by the circle 1A in FIG. 1.

More particularly, in the exemplary embodiment the sound-producing body 22 is a bell 26 affixed to the barrel portion 20 of the elongated shaft 12 at the other opposite end 12B thereof. The bell 26 is configured to produce a ringing sound when struck. As best seen in FIGS. 1 and 1A, the bell 26 may be cup-shaped so as to define a cavity 27 open at one end 27A that receives the barrel portion 20 of the elongated shaft 12 at its other opposite end 12B being affixed, such as by welding, to a central portion 26A of the bell 26 such that the open one end 27A of the cavity 27 of the bell 26 faces toward the handgrip portion 18 of the elongated shaft 12 and thus toward the batter so that the batter will have the best opportunity to clearly hear the sound when the batter during the dry swing is at the position of simulated ball contact, as shown in FIG. 5B.

Figure 4:
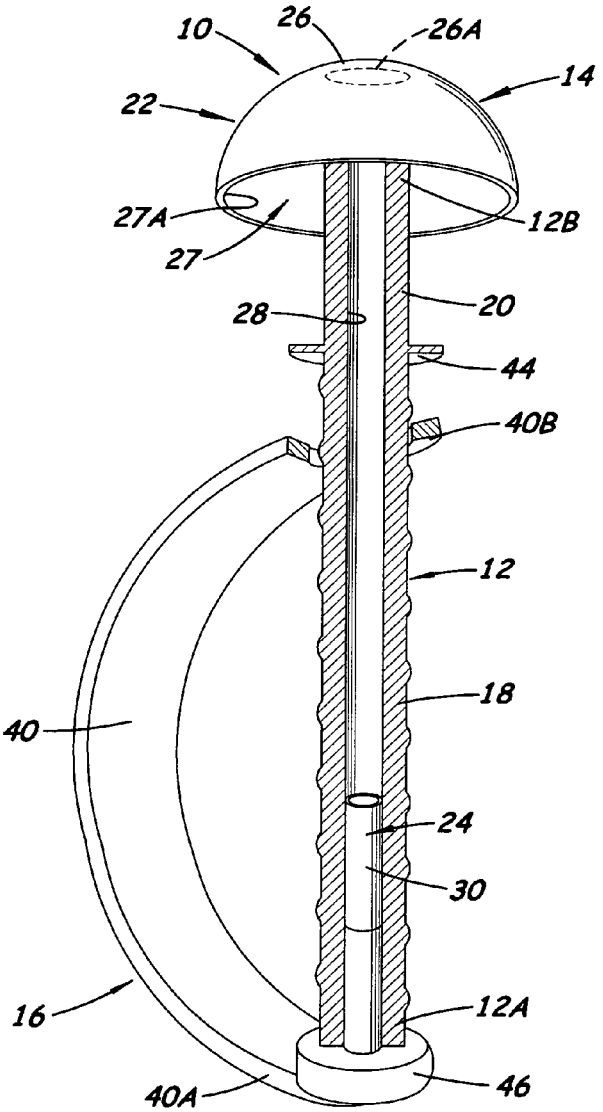
FIG. 4 is an assembled side elevational view of the training bat apparatus showing its elongated shaft being in longitudinal sectional form to show an elongated bore in the shaft and components received in the shaft bore.

Also, as seen in FIG. 4, in the exemplary embodiment the elongated shaft 12 is in a tubular form so as to have an elongated bore 28 formed therein extending between and open at the opposite ends 12A, 12B of the shaft 12. At least the interior side of the central portion 26A of the bell 26, as indicated in dashed outline in FIG. 2, at which the bell 26 is affixed to the other opposite end 12B of the elongated shaft 12, as seen in FIG. 1A, is exposed to the bore 28 at the other opposite end 12B of the shaft 12.

Further, in the exemplary embodiment the impact-producing body 22 is a striker component or member 30, as seen in FIGS. 3 and 4, inserted into the elongated bore 28 at the open one opposite end 12A of the elongated shaft 12 so as to be received within the bore 28 for undergoing slidable movement between the opposite ends of the shaft 12. The striker member 30 may be made of any suitable material, such as steel, iron, a metal alloy, plastic or a composite material being of sufficient mass to strike the exposed central portion 26A of the bell 26 and produce the ringing sound in response to the dry swing of the training bat apparatus 10 by the batter. The shape of the striker member 30 may be a solid piece, round, square, hollow, octagon or any shape that will fit inside and slide "back and forth" in the bore 28. Also, the elongated bore 28 may have a peg-shaped plug member 32 snugly fitted therein so as to provide a stop at the open end of the bore 28 at the one opposite end 12A of the shaft 12 that prevents the striker member 30 from sliding out of the bore 28 of the shaft 12 through the open one opposite end 12A thereof.

To summarize, the bell 26 serves three functions. First, it acts as a stop for the sliding striker member 30 that moves up and down the bore 28 during the swinging process. Second, the shape of the open cavity 28 of the bell 26, and the metal of which it is fabricated, serves to make a loud ring when the striker member 30 impacts the bell 26. Third, the open cavity 28 of the bell 26 faces the batter, facilitating the batter's capability to hear the ringing sound because the bell 26 directs the sound back toward the batter. Also, the enlarged semi-spherical shape of the bell 26 is designed to discourage the batter from hitting the ball with the training bat apparatus 10. Thus, a batter is allowed to take a normal swing and listen for the bell 26 to produce the ringing sound. An incorrect, casting-type swing will result in the "bell ringing" taking place prematurely or behind the batter or toward the opposite batter's box. A correct, short-type swing will result in the "bell ringing" taking place in front of the batter, at the point of optimum ball contact, or toward the pitcher. Over time the batter will learn to have proper timing, bat speed, and swing technique to make the bat bell ring at the proper time.

Figure 9:
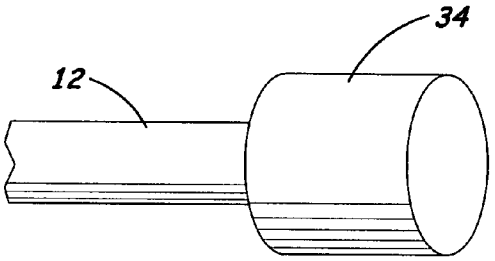
FIG. 9 is a side elevational view of an alternative embodiment of the audible swing quality indicator on the training bat apparatus.
Figure 10:
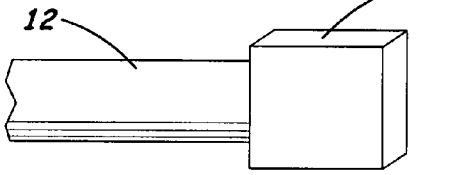
FIG. 10 is a side elevational view of another alternative embodiment of the audible swing quality indicator on the training bat apparatus.
Figure 11:
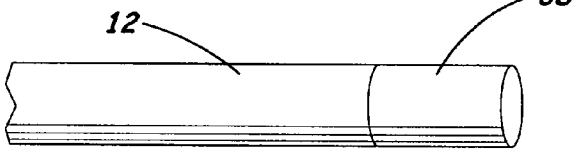
FIG. 11 is a side elevational view of another alternative embodiment of the audible swing quality indicator on the training bat apparatus.
Figure 12:
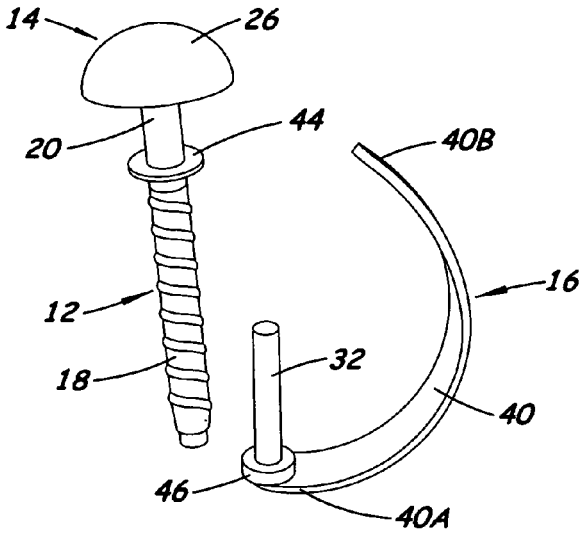
FIG. 12 is an enlarged perspective view of components of the training bat apparatus shown in FIG. 3 in the form of an integrally formed plug stop and end knob attached to a grip guard of the visual swing quality indicator before being assembled to the shaft of the training bat apparatus.
Figure 13:
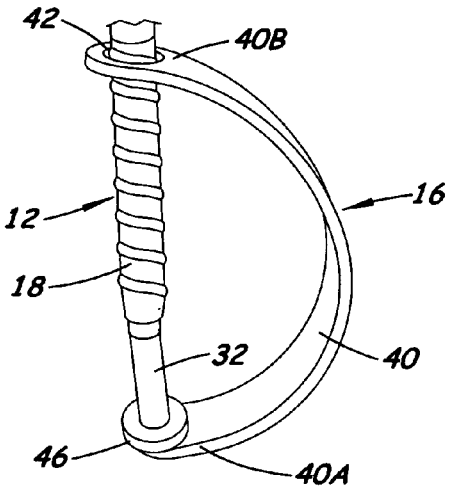
FIG. 13 is a view similar to that of FIG. 12 but showing the visual swing quality indicator after the grip guard thereof is assembled to the shaft of the training bat apparatus.
Figure 14:
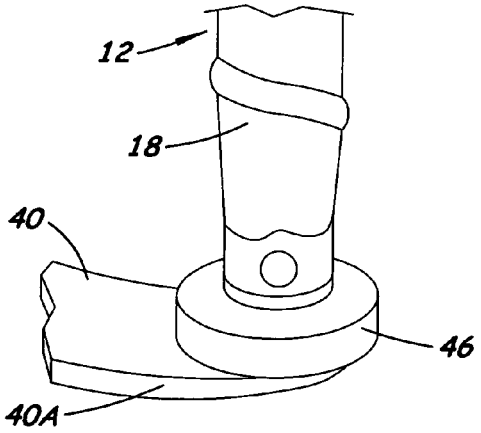
FIG. 14 is an enlarged fragmentary perspective view oriented 180° from the view shown in FIG. 13 of an end knob attached to the training bat apparatus shaft and showing an end portion of the grip guard attached thereto.
Figure 15:
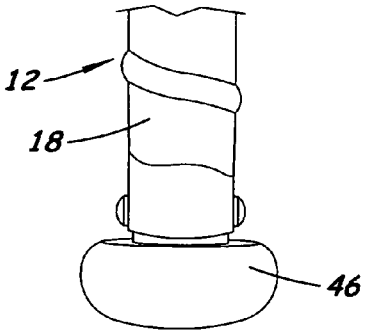
FIG. 15 is a side elevational view oriented 90° from the view shown in FIG. 14 of the end knob attached to the training bat apparatus shaft.

In FIGS. 9-11, there are illustrated alternative embodiments of the audible swing quality indicator that may be incorporated on the training bat apparatus. The cup-shape configuration of the bell 26 is an example of only one design of the sound-producing body 20. Examples of other designs include a round- or cylindrical-shaped bell 34, as shown in FIG. 9, or a rectangular-shaped bell 36, as shown in FIG. 10. Another alternative embodiment of the sound-producing body 20 is to fill the bore 28 at other opposite end 12B of the shaft 12 with a plug of material 38, such as lead or a heavy metal, as seen in FIG. 11, which will produce a non-ringing sound, such as a pop or thump when impacted by the striker member 30. In the case of the latter alternative embodiment there would then be no component on the outside of the end 12B of the barrel portion 20 of the elongated shaft 12.

Visual Swing Quality Indicator

In one exemplary embodiment as also illustrated in FIGS. 1, 1A, 2-4, 5A and 5B, the visual swing quality indicator 16 may take the form of a hand or grip guard 40 of an arcuate shape. The grip guard 40 at its opposite ends 40A, 40B is coupled to the elongated shaft 12 so as to retain the grip guard 40 at a set radial position relative to the handgrip portion 18 of the shaft 12 and allow the grip guard 40, extending along and in a spaced relationship to the shaft 12, to span over at least the handgrip portion 18 of the shaft 12. The grip guard 40 may be provided in a bright color, such as red, that contrasts with the color of the other components of the training bat 10 so as to increase the visibility of the grip guard 40. The bright color allows a coach or instructor to observe and instantly assess the quality of a swing from a safe distance away. The grip guard 40 ensures that the desired "palm-up/palm-down" gripping technique (explained hereinafter) is used on every practice swing. If the proper grip is not used or if the batter rolls the wrist, the grip guard 40 acting as a visual indicator will be in a down location at the time the swing bell rings. A coach standing at a distance can check the batter's grip and swing just by observing the location of the grip guard 40 during the swing. The grip guard 40 of the visual swing quality indicator 16 having this configuration and color not only serves the purpose of representing the quality of the dry swing, but also serves as a shield for protecting the gripped hands of the batter from being struck by the pitched ball, particularly in the case of pitches too far inside on the batter.

The one opposite end 40A of the grip guard 40 is fixedly coupled to the one opposite end 12A of the elongated shaft 12 so as to retain the grip guard 40 at the set radial position relative to the handgrip portion 18 of the shaft 12 so as to allow the grip guard 40 to extend along and in a spaced relationship to the handgrip portion 18 of the shaft 12. The other opposite end 40B of the grip guard 40 is ring-shaped in that it has a hole 42 defined through it being configured to allow the elongated shaft 12 to extend through the hole 42. The ring-shaped other opposite end 40B of the grip guard 40 may reach and come to rest against an annular stop 44, such as in the form of a rim or washer as seen in FIGS. 1, 1A, 3 and 4, affixed about the shaft 12 at a location between the handgrip and barrel portions 18, 20 of the shaft. Thus, the other opposite end 40B of the grip guard 40 is placed at the location between the handgrip and barrel portions 18, 20 of the shaft 12.

More particularly, in FIGS. 12-15 the grip guard 40 at the one opposite end 40A thereof is fixedly attached to an annular knob 46 incorporated or formed on an outer end of the aforementioned peg-shaped plug member 32 which is snugly fitted into the open end of the bore 28 at the one opposite end 12A of the shaft 12 after the striker member 30 has been inserted into the bore 28 of the shaft 12. The annular knob 46 simulates the knob on the handle end of a regulation bat. The length of the plug member 32 can be varied to adjust the length of the bore 28 and thereby the amount of energy and hand speed that must be exerted by a batter to make the striker member 30 move to the bell 26 during the dry swing. The adjustment can be adapted to the bat speed and strength of the batter. As an example, in the case of younger batters or softball batters a longer plug member 32 may be used. The grip guard 40 may be fabricated of a suitable flexible plastic material in a flat orientation that can then be bent into an arcuate shape for assembling it to the shaft 12 of the training bat 10. The grip guard 40, the annular knob 46 and the peg-shaped plug member 32 may be integrally molded as one unit, as seen in FIGS. 3 and 12-14, from materials, such as polyurethane, hard plastics, metal and other suitable molded and non-molded materials.

Figure 17:
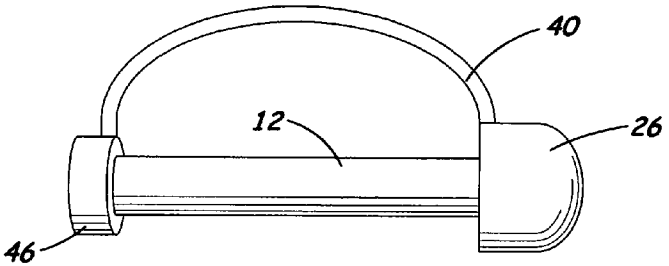
FIG. 17 is a side elevational view of another alternative embodiment of the visual swing quality indicator on the training bat apparatus.
Figure 19:
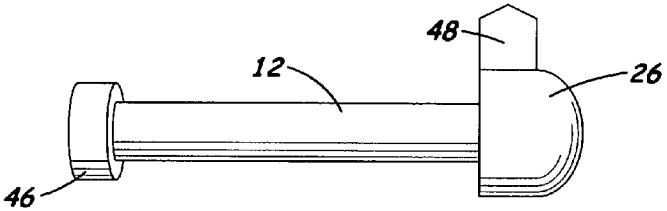
FIG. 19 is a side elevational view of yet another alternative embodiment of the visual swing quality indicator on the training bat apparatus.
Figure 16:
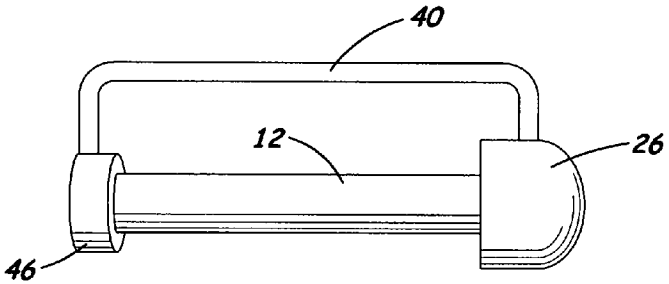
FIG. 16 is a side elevational view of an alternative embodiment of the visual swing quality indicator on the training bat apparatus.
Figure 18:
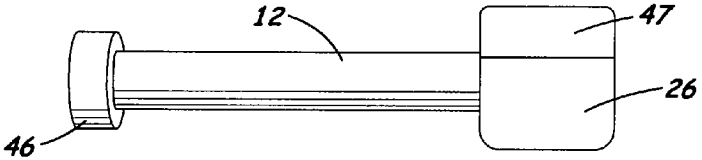
FIG. 18 is a side elevational view of still another alternative embodiment of the visual swing quality indicator on the training bat apparatus.

FIGS. 16-19 show other alternative embodiments of the visual swing quality indicator on the training bat apparatus. In FIGS. 16 and 17, the grip guard 40 is shown extending from the annular knob 46 to the bell 26. In FIG. 16 the grip guard 40 has a semi-rectangular configuration, while in FIG. 17 the grip guard 40 has a curved configuration. FIGS. 18 and 19 show that the visual swing quality indicator may take other forms than that of a grip guard. FIG. 18 shows a mark 47 applied, such as by painting, on a side of the bell 26 (or handgrip or barrel portions 18, 20) of the training bat may serve as the visual swing quality indicator, whereas as seen in FIG. 19 a protuberance 48 formed (molded) or attached (welded on) in some fashion on a side of the bell 26 (or handgrip or barrel portions 18, 20) may serve this purpose. The protuberance 48 may vary from an arrow shape to a bump, a round shape or other suitable configuration.

Figure 20C:
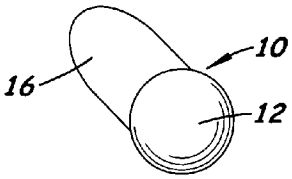
FIGS. 20A-20C are diagrammatic views of different orientations of the visual swing quality indicator identifying a correct batting swing in FIG. 20A and two flawed batting swings in FIGS. 20B and 20C.
Figure 20B:
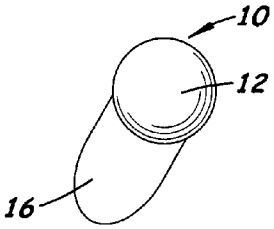
Figure 20A:
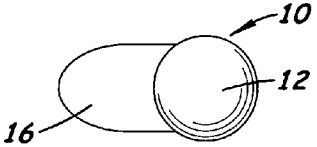

FIGS. 20A-20C show diagrams of different orientations of the visual swing quality indicator 16 on the training bat apparatus shaft 12 during swings of the training bat apparatus 10. FIG. 20A identifies a correct batting swing wherein the indicator 16 is level with the field at the position of simulated contact of the training bat apparatus 10 with the pitched ball. FIGS. 20B and 20C identify two flawed batting swings.

In FIG. 20A, a proper swing is represented by the level indicator 16 (see also FIG. 5A), telling the batter or an observing coach that the hands are in the correct "palm-up/palm-down" position at the time of contact. This phrase is used to describe how the hands should be positioned on the training bat apparatus 10 at the point of simulated contact with the pitched ball. One palm should be facing upward toward the sky while the other palm is facing downward toward the ground. If this position is not present at simulated contact, most likely the batter is rolling the wrists over too fast and causing ground balls to occur. When the hands are palm-up and palm-down more power is generated and contact is maintained longer through the ball. This is commonly called getting proper extension through the ball.

In FIG. 20B, a flawed swing at the point of simulated contact is represented by the downward turned indicator 16, telling the batter or an observing coach that the wrists rolled prematurely or too early. Rolling the wrists before or near contact is a serious mechanical flaw that results in loss of power and consistency. The early rolling of the wrist causes the lead elbow to start breaking down-and-in too soon. This alters the natural trajectory or plane of the swing. Most batters who finish their swing low will also have a problem with the wrist roll. Limited shoulder rotation and having the body too vertical or tilted toward the pitcher at contact are also characteristics of the wrist roll. The rolling over of the wrist is a natural part of the baseball swing when it occurs at the proper time. It will naturally take place when both arms come almost to full extension and they form a "V" position.

In FIG. 20C, another flawed swing at the point of simulated contact is represented by the upward turned indicator 16, telling the batter or an observing coach that the batter is exhibiting the common hitting flaw known as "dipping the backside" or the back shoulder. This dipping is when a batter's back shoulder drops along with the hands during the stride. This common flaw destroys the integrity of the batter's swing. The swing will become an upper-cut swing that causes the batter to hit pop-ups, fly balls, or weak ground balls back to the pitcher. This movement causes the hitter's swing path to be offline of the path of the pitch.

Other Features

Figure 22A:
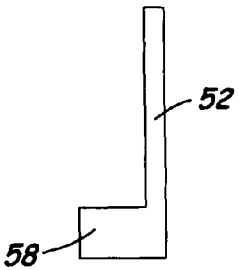
FIG. 22A is a side elevational view of the mat as seen along line 22A-22A of FIG. 22.
Figure 22:
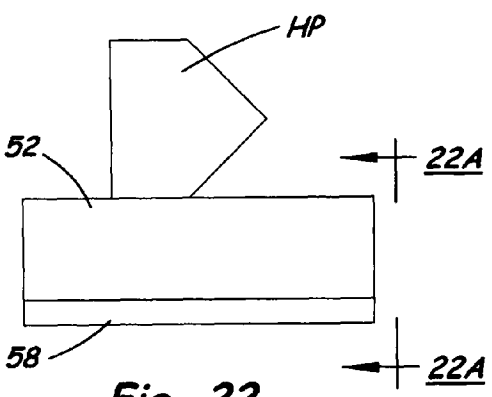
FIG. 22 is a top plan view of an alternative embodiment of the mat that may be deployed and used as part of the training bat apparatus.
Figure 21A:
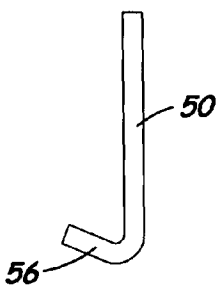
FIG. 21A is a side elevational view of the mat as seen along line 21A-21A of FIG. 21.
Figure 21:
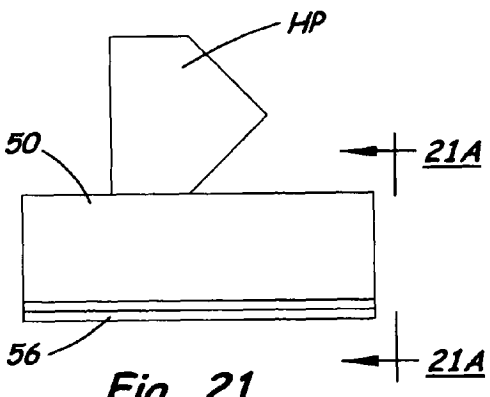
FIG. 21 is a top plan view of one embodiment of a mat that may be deployed and used as part of the training bat apparatus.
Figure 23A:
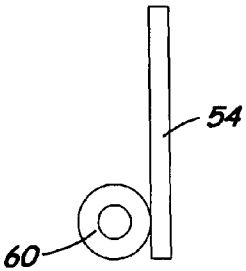
FIG. 23A is a side elevational view of the mat as seen along line 23A-23A of FIG. 23.
Figure 23:
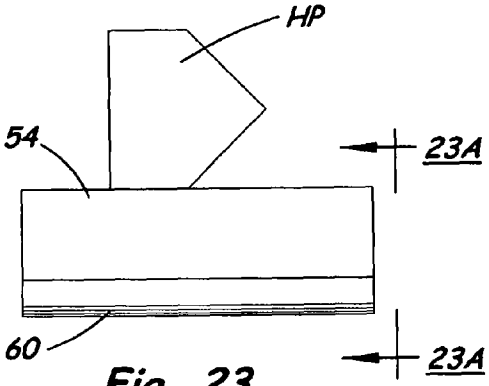
FIG. 23 is a top plan view of another alternative embodiment of the mat that may deployed and used as part of the training bat apparatus.

FIGS. 21-23 illustrate alternative embodiments of a guide in the form of a mat 50, 52, 54 that may be deployed and used as part of the training bat apparatus 10. When using the training bat apparatus 10 batters are instructed to back off home plate HP a safe distance, such being a minimum of twelve inches, to ensure that during a dry swing, no contact is made with the pitched ball. The placement of the mat 50, 52, 54 adjacent to home plate HP serves as a reminder to the batter of where to stand. A raised ridge or rail 56, 58, 60 on the mat 50, 52, 54, provided along an edge being opposite the edge next to home plate HP restricts how close the batter can get to home plate HP. The difference between the mats 50, 52, 54, as shown in FIGS. 21-23, is in the configuration of the raised ridges or rails 56, 58, 60. The different edge configurations are shown in FIGS. 21A-23A.

Figure 24:
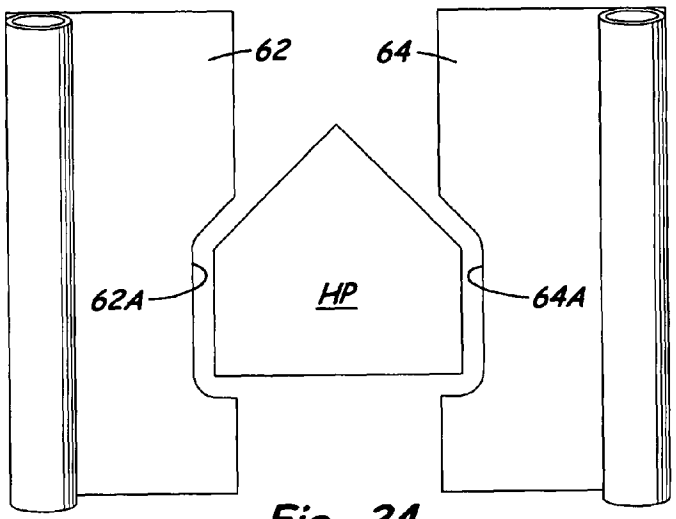
FIG. 24 is a top plan view of another alternative embodiment of the mat that may be deployed and used as part of the training bat apparatus, with mats being shown having cutouts for right and left handed batter positions that extend the full length of a regulation batter's box.

FIG. 24 shows other alternative embodiments of the mat that may be deployed and used as part of the training bat apparatus 10. The mats 62, 64 have cutouts 62A, 64A for right and left handed batter positions that nest with the opposite sides of home plate HP. The cutouts 62A, 64A ensure that the respective mats 62, 64 are placed properly next to home plate HP. The mats 62, 64 also may extend the full fore-and-aft length of a regulation batter's box, as shown in FIG. 24.

Figure 25:
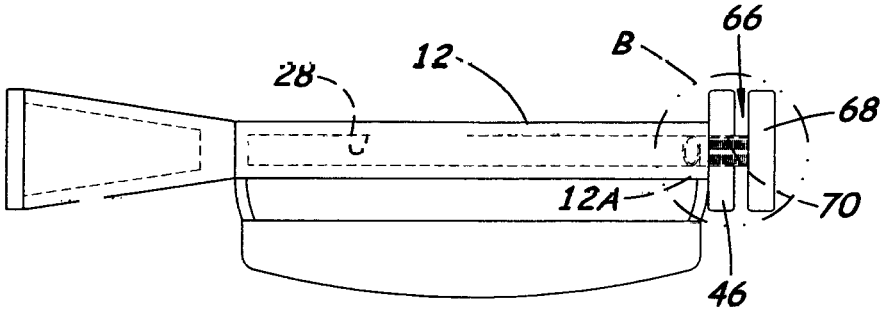
FIG. 25 is a diagrammatic view of an embodiment of the training bat apparatus showing weight added to it at several locations including by use of supplemental knob-shaped weight being threadable into the knob end of the bat shaft.
Figure 26:
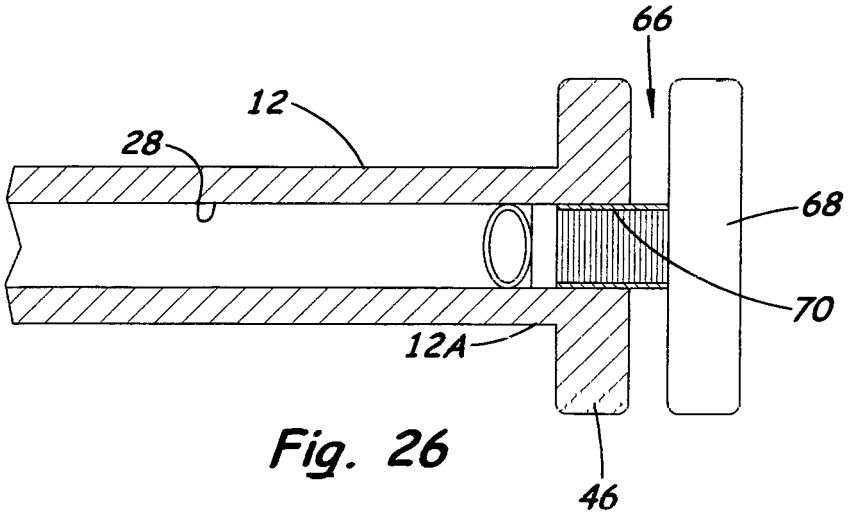
FIG. 26 is an enlarged fragmentary view of the portion of the training bat apparatus bounded by the circle B in FIG. 25.

In FIGS. 25 and 26 an embodiment of the training bat apparatus is illustrated having weight added to it at several locations including by use of supplemental knob-shaped weight device 66 having a threaded male member 68 that threads into a threaded female cavity 70 through the annular knob 46 on the one opposite end 12A of the bat shaft 12. The weight device 66 can be screwed inward more to get the weight closer to the knob 46 or screwed outward to get a greater distance from the knob 46. This change in distance will increase or decrease the weighted effect on the batter.

Some models of the training bat apparatus 10 can be made with the exact same weight as regulation or game bats used at various levels of baseball and softball play. If so desired, other models can be made "over weight" which is a weight that is heavier than regulation or game bat weight. The purpose of using the training bat apparatus model with added weight is to build arm, hand, shoulder and other muscle strength. Still other models can be made "under weight" which is a weight that is lighter than regulation or game bat weight. The purpose is to speed up the movement of the hands, wrist arms and shoulders with a light-weighted training bat. It is the opinion of many baseball and softball coaches that in order to speed up hand movement the hands must be trained to move fast. Such process develops fast twitch muscles that are vital to quicker hand movement. Furthermore, the training bat apparatus 10 can be provided in different lengths, for example, between eight and eighteen inches. The optimum length is twelve to fourteen inches.

Figure 27:
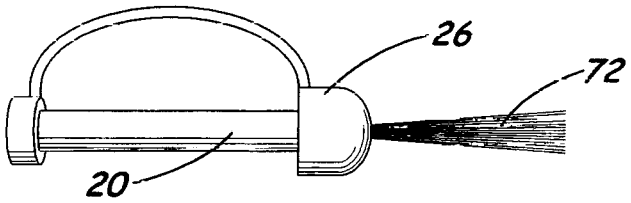
FIG. 27 is a side elevational view of an embodiment of the training bat apparatus having a bristle fiber attachment extending from the barrel portion of the bat for simulating real bat barrel contact with a pitched ball.

FIG. 27 shows an embodiment of the training bat apparatus having a bristle fiber attachment 72 attached to and extending from the bell 26 at the end of the barrel portion 20 of the bat. The bristle fiber attachment 72 may be made of lightweight plastic, nylon or other fibers that are bunched or bundled together to simulate a regulation bat barrel and thus simulate its contact with the pitched ball. The purpose of this attachment 72 is to allow the batter to swing and actually see the pitched ball made contact with the fibers which represent or simulate the barrel of a regulation bat. Ball flight is not changed, affected or altered by such contact because the fibers are so flexible and lightweight that the ball bends them and passes onto the catcher's mitt without changing speed or direction of flight. This also allows catchers to be trained not to have "bat blindness", a condition when catchers are distracted, closes their eyes or flinches when a batter swings the bat.

Figure 28:
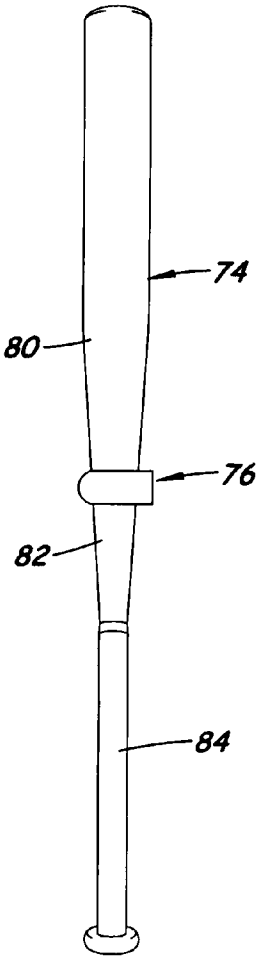
FIG. 28 is a longitudinal view of a regular baseball or softball bat with another alternative embodiment of a visual swing quality indicator mounted thereon.
Figure 28C:
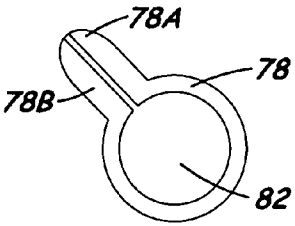
FIGS. 28A-28C are cross-sectional views of the regular baseball or softball bat of FIG. 28 with the alternative embodiment of the visual swing quality indicator shown at different orientations identifying a good quality or level batting swing in FIG. 28A and two poor quality or flawed batting swings in FIGS. 28B and 28C.
Figure 28B:
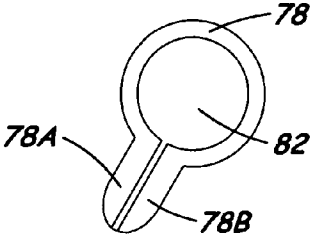
Figure 28A:
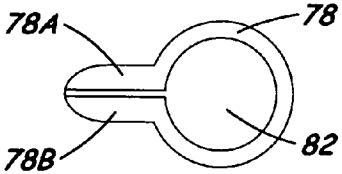

FIG. 28 shows a regulation baseball or softball bat 74 with another alternative embodiment of a visual swing quality indicator device 76 mounted thereon. This version will identify flaws and/or indicate swing quality during a batting practice or batting session, rather than during simulated batting in conjunction with a pitching and catching bullpen session. The indicator device 76 is attached by a flexible member 78, for example, a strap with snaps, buckles, or hook and loop strips, etc., that fits about the barrel 80 of the bat 74 at the segment 82 of the bat sloping from the handle grip 84 to the barrel 80. The opposite ends 78A, 78B of the flexible member 78 that are secured or mated together function as the directional feature of the indicator device 76. Alternatively, the indicator device 76 may be attached to the barrel 80 or to the handle grip 84. FIGS. 28A-28C are cross-sectional views of the regular baseball or softball bat 76 of FIG. 28 where the secured or mated opposite ends 78A, 78B of the flexible member 78 forming the indicator device 76 are shown at different orientations so as to identify a good quality or level batting swing in FIG. 28A and two poor quality or flawed batting swings in FIGS. 28B and 28C. The poor quality swing identified in FIG. 28B is likely caused by the hands/wrists rolling over too soon. The poor quality swing identified in FIG. 28C is likely caused by the batter collapsing or dipping his or her back shoulder.

Figure 29:
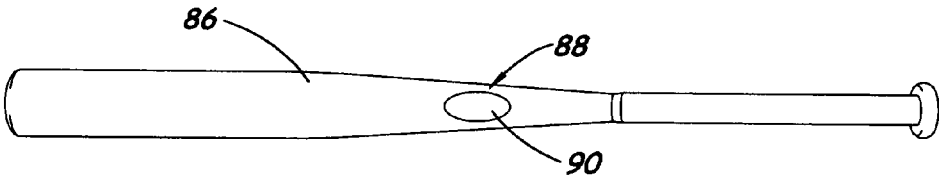
FIG. 29 is a top elevational view of a regular baseball or softball bat with another alternative embodiment of a visual swing quality indicator mounted thereon.
Figure 30:
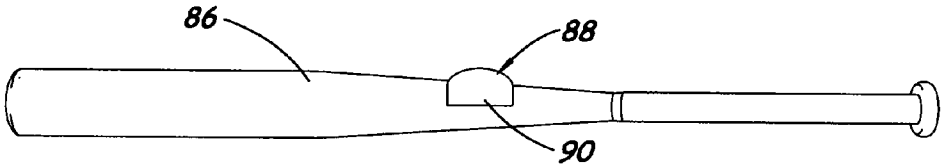
FIG. 30 is a side elevational view of the bat shown in FIG. 29.

Finally, FIGS. 29 and 30 both show a regulation baseball or softball bat 86 with still another alternative embodiment of a visual swing quality indicator device 88 mounted thereon. The indicator device 88 is in the form of a small molded foam attachment 90 that has an adhesive backing (not shown) that is pulled off and the attachment 90 is then stuck onto the surface 86A of the bat 86 so as to provide a directional protuberance thereon. The explanation given above with reference to FIGS. 28A-28C with respect to what the different orientations of the indicator device 88 mean would likewise be applicable to the different orientations of the indicator device 88.

Benefits and Advantages

The above-described training bat apparatus 10 of the present invention represents a breakthrough in baseball training efficiency by opening up completely new opportunities for batters, pitchers and catchers to practice and train together. Batters are allowed to stand in during bullpen pitching sessions to get live pitch tracking action. The training bat apparatus is held in a pre-pitch launch position, as seen in FIG. 5A, the same as the normal regulation bat during a game. The batter can practice his or her normal bating routine or approach with a high number of repetitive pitches during the pitcher's bullpen pitching practice session. The batter learns visual focus and mental concentration under "game pressure" simulated conditions on every pitch. The batter and pitcher can compete or battle using the batter's count to either achieve a hit, a walk, or a strikeout. The umpire for the competition is normally the catcher, but a fourth person located behind a protective screen located behind the catcher and batter could be the umpire.

The various activities or drills that can be practiced using the training bat apparatus of the present invention are as follows: (1) "known pitch" swings in which the catcher tells batter what pitch is coming whereby the batter expects the pitch and swings accordingly; (2) "never-know" swings in which the batter is not told what pitch is coming whereby the batter expects a fastball and has to adjust to a curveball or expects the ball away and has to adjust to the ball being at inside locations; (3) "live-count" drill in which the batter faces the pitcher; (4) "game signs" drill in which a coach gives the batter a sign of what "execution" is needed; (5) "sac-bunt" drill; (6) "base-hit bunt" drill; (7) "squeeze bunt" drill; (8) "hit-n-run" drill; (9) "runner-on-3B" drill; (10) "bunt slash" drill; (11) "2-0" drill; and (12) "0-2" drill.

Batters, pitchers, catchers and coaches can realize numerous benefits when the training bat apparatus is utilized. For batters, they are able to: (1) receive game quality at-bats facing full speed pitching which is a great way to establish a batter's game speed batting experience; (2) track pitches from the pitcher's hand to the catcher's mitt; (3) dry swing at strikes; (4) hear audible "contact pop" which gives instant feedback on swing quality; (5) observe the hand guard/barrel indicator which allows instant recognition of proper or incorrect hand position and swing quality; (6) perform any desired swinging and bunting bat control function; (7) get valuable game "batter vs. pitcher" battle experience; (8) learn correct contact points for the "middle, in, or away" strike location; (9) work on turning away from pitches inside; (10) work on proper "loading" timing; (11) work on proper bunting timing; (12) work on executing a plan with certain pitch counts; (13) perfect a proper approach and build confidence performing under pressure; (14) practice situational hitting timing; (14) learn to "pick-up-on" or see the spin of breaking balls; and (15) learn to see the pitcher's ball release point.

For pitchers, they are able to: (1) receive the benefit of pitching to a live batter; (2) perform under added pressure; (3) have live counts taken to simulate game pressure; (4) see a batter for pitching location reference; (5) experience game quality at-bets and battles between the pitcher and batter which builds confidence and game readiness; (6) learn to hit the desired pitch spots with a live batter as a reference point; (7) learn to set up pitches by pitching inside and outside sequences just as he or she would in a game; and (8) learn to locate pitches when he or she is ahead in the count or to throw strikes when behind in the count.

For catchers, they are able to: (1) learn to call pitches with a live batter in the box; (2) learn to frame inside and outside pitches with a batter in the box; (3) learn to use proper set-up timing to prevent batter tip-off and sneak peeks; (4) learn to see and catch the ball with the presence of a batter in the box; (5) learn to catch the ball when a batter swings and misses on a swing.

For coaches, they are able to quickly identify the quality of the batter's swing by observing the position or direction that the swing quality indicator is directed at the point of impact. If the indicator is pointed downward at the desired point of impact, the batter has rolled the wrist and hands over prematurely to an undesirable position. If the indicator is flat and directed toward the ball, the batter is using the correct "palm-up/palm-down" technique on the practice swing. If the indicator is pointed up or starts upward at any point during the swing, the batter has collapsed on the back leg, an undesirable batting flaw. A coach can have a batter practice getting a sign and performing certain desired game situational tasks, such as sacrifice bunt, hit and run, drag bunting, push bunting, fake bunt slash, or calling time to disrupt a pitcher's timing.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball; and an audible swing quality indicator being arranged on said elongated shaft so as to produce a noticeable sound in response to said training bat apparatus, when gripped at said handgrip portion of said shaft by a batter, being moved through a dry swing at a pitched ball such that by recognizing what the position of said training bat apparatus is during the dry swing, relative to a given point of simulated ball contact with the pitched ball, when the sound is produced, an indication is provided of the relative quality of the dry swing of the batter in terms of its timing, speed and technique, thereby enabling the batter to undergo effective dry batting training using the training bat apparatus in conjunction with a pitcher and catcher undergoing respective pitching and receiving training in a bullpen session;

wherein said audible swing quality indicator includes a sound-producing body and an impact-producing body adapted to strike said sound-producing body;

wherein said sound-producing body is a bell affixed to said barrel portion of said elongated shaft at said other opposite end thereof and being configured to produce a sound when struck;

wherein said elongated shaft has an elongated bore formed therein extending between and open at said opposite ends of said shaft such that at least a portion of said bell is exposed to said bore at said other opposite end of said shaft; and wherein said impact-producing body is a striker member received within said elongated bore of said elongated shaft so as to be slidably movable within said bore and of sufficient mass to strike said exposed portion of said bell and produce the sound in response to said dry swing of said training bat apparatus by the batter.

2. The training bat apparatus of claim 1 wherein said bell is cup-shaped and defines a cavity open at one end and receiving said barrel portion of said elongated shaft at said other opposite end thereof at which said barrel portion of said shaft is affixed to said bell such that said cavity of said bell faces toward said handgrip portion of said elongated shaft.

3. The training bat apparatus of claim 1 wherein said elongated bore has a plug member snugly fitted therein so as to provide a stop at said first end of said bore being located at said one opposite end of said shaft that prevents said striker member from sliding out of said bore of said shaft through said first end thereof.

4. The training bat apparatus of claim 1 further comprising a knob-shaped weight engaged with said one opposite end of said shaft and being adjustable to change the effect of said weight on the batter.

5. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball;

an audible swing quality indicator being arranged on said elongated shaft so as to produce a noticeable sound in response to said training bat apparatus, when gripped at said handgrip portion of said shaft by a batter, being moved through a dry swing at a pitched ball such that by recognizing what the position of said training bat apparatus is during the dry swing, relative to a given point of simulated ball contact with the pitched ball, when the sound is produced, an indication is provided of the relative quality of the dry swing of the batter in terms of its timing, speed and technique, thereby enabling the batter to undergo effective dry batting training using the training bat apparatus in conjunction with a pitcher and catcher undergoing respective pitching and receiving training in a bullpen session; and a bristle fiber attachment attached to and extending from said barrel portion at said other opposite end of said shaft to simulate a regulation bat barrel and thus simulate contact of the regulation bat barrel with a pitched ball.

6. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball;

an audible swing quality indicator being arranged on said elongated shaft so as to produce a noticeable sound in response to said training bat apparatus, when gripped at said handgrip portion of said shaft by a batter, being moved through a dry swing at a pitched ball such that by recognizing what the position of said training bat apparatus is during the dry swing, relative to a given point of simulated ball contact with the pitched ball, when the sound is produced, an indication is provided of the relative quality of the dry swing of the batter in terms of its timing, speed and technique, thereby enabling the batter to undergo effective dry batting training using the training bat apparatus in conjunction with a pitcher and catcher undergoing respective pitching and receiving training in a bullpen session; and at least one mat configured to be deployed adjacent a home plate and having a raised ridge along one edge of said mat opposite another edge of the mat next to the home plate so as to restrict how close a batter can stand to the home plate.

7. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball; and a visual swing quality indicator being arranged on said elongated shaft in a given radial position along a longitudinal side, and relative to a longitudinal axis, of said elongated shaft for enabling placement of the hands of a batter in a given proper tandem grip about said handgrip portion of said elongated shaft being in a given proper alignment with said visual swing quality indicator so as to hold said training bat apparatus in a proper pre-pitch launch position at the start of a dry swing of said training bat apparatus at the pitched ball such that said visual swing quality indicator is enabled to represent, in accordance with its angular position relative to the playing field, how well the batter has guided said training bat apparatus along a given proper path of dry swing through a position of simulated ball contact, thereby enabling the batter to undergo effective dry batting training using said twining bat apparatus in conjunction with a pitcher and catcher undergoing respective pitching and receiving training in a bullpen session;

at least one mat configured to be deployed adjacent a home plate and having a raised ridge along one edge of said mat opposite another edge of the mat next to the home plate so as to restrict how close a batter can stand to the home plate.

8. The training bat apparatus of claim 7 wherein said visual swing quality indicator is a grip guard of an arcuate shape, said grip guard having a pair of opposite ends being coupled to said elongated shaft so as to retain said grip guard at a set radial position relative to said handgrip portion of said shaft and allow said grip guard, extending along and in a spaced relationship to said shaft, to span over at least said handgrip portion of said shaft.

9. The training bat apparatus of claim 8 wherein said grip guard at said one opposite end thereof is fixedly coupled to said one opposite end on said handgrip portion of said elongated shaft, and said grip guard at said other opposite end thereof is slidably coupled to said other opposite end on said barrel portion of said elongated shaft.

10. The training bat apparatus of claim 9 wherein said other opposite end of said grip guard has a hole therethrough being configured to allow said elongated shaft to extend through said hole so as to place said other opposite end of said grip guard at a location between said handgrip and barrel portions of said shaft.

11. The training bat apparatus of claim 7 wherein said visual swing quality indicator is a protuberance formed on said barrel portion of said elongated shaft adjacent to and at a fixed radial position relative to said handgrip portion of said shaft.

12. The training bat apparatus of claim 7 wherein said visual swing quality indicator is a mark applied on said barrel portion of said elongated shaft adjacent to and at a fixed radial position relative to said handgrip portion of said shaft.

13. The training bat apparatus of claim 7 further comprising a knob-shaped weight engaged with said one opposite end of said shaft and being adjustable to change the effect of said weight on the batter.

14. The training bat apparatus of claim 7 further comprising a bristle fiber attachment attached to and extending from said barrel portion at said other opposite end of said shaft to simulate a regulation bat barrel and thus simulate contact of the regulation bat barrel with a pitched ball.

15. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball;

an audible swing quality indicator being arranged on said elongated shaft so as to produce a noticeable sound in response to said training bat apparatus, when gripped at said handgrip portion of said shaft by a batter, being moved through a dry swing at a pitched ball such that by recognizing what the position of said training bat apparatus is during the dry swing, relative to a given position of simulated ball contact with the pitched ball, when the sound is produced, an indication is provided of the relative quality of the dry swing of the batter in terms of its timing, speed and technique, thereby enabling the batter to undergo effective dry batting training apparatus using the training bat in conjunction with a pitcher and catcher undergoing respective pitching and receiving training in a bullpen session; and a visual swing quality indicator being arranged on said elongated shaft in a given radial position along a longitudinal side, and relative to a longitudinal axis, of said elongated shaft for enabling placement of the hands of a batter in a given proper tandem grip about said handgrip portion of said elongated shaft being in a given proper alignment with said visual swing quality indicator so as to hold said training bat apparatus in a proper pre-pitch launch position at the start of a dry swing of said training bat at the pitched ball such that said visual swing quality indicator is enabled to represent, in accordance with its angular position relative to the playing field, how well the batter has guided said training bat apparatus along a given proper path of dry swing through a position of simulated ball contact, thereby enabling the batter to undergo effective dry batting training using said training bat in conjunction with a pitcher and catcher undergoing respective pitching and receiving training in a bullpen session;

wherein said audible swing quality indicator includes a sound-producing body and an impact-producing body adapted to strike said sound-producing body;

said sound-producing body is a bell affixed to said barrel portion of said elongated shaft at said other opposite end thereof and being configured to produce the sound when struck;

said elongated shaft has an elongated bore formed therein extending between and open at said opposite ends of said shaft such that at least a portion of said bell is exposed to said bore at said other opposite end of said shaft; and said impact-producing body is a striker member received within said elongated bore of said elongated shaft so as to be slidably movable within said bore and of sufficient mass to strike said exposed portion of said bell and produce the sound in response to said dry swing of said training bat apparatus by the batter.

16. The training bat apparatus of claim 15 wherein said bell is cup-shaped and defines a cavity open at one end and receiving said barrel portion of said elongated shaft at said other opposite end thereof at which said barrel portion of said shaft is affixed to said bell such that said cavity of said bell faces toward said handgrip portion of said elongated shaft.

17. The training bat apparatus of claim 15 wherein said visual swing quality indicator is a grip guard of an arcuate shape and flexible configuration, said grip guard having a pair of opposite ends being coupled to said elongated shaft so as to retain said grip guard at a set radial position relative to said handgrip portion of said shaft and allow said grip guard, extending along and in a spaced relationship to said shaft, to span over at least said handgrip portion of said shaft, said grip guard at one of said opposite ends thereof being fixedly attached to an annular knob on a plug member snugly fitted into said first end of said bore of said elongated shaft at said handgrip portion of said shaft so as to provide a stop at said first end of said bore that prevents said striker member from sliding out of said bore of said shaft through said first end thereof.

18. The training bat apparatus of claim 17 wherein said grip guard at the other of said opposite ends thereof has a hole therethrough being configured to allow said elongated shaft to extend through said hole until reaching an annular stop formed about said shaft at a location between said handgrip and barrel portions of said shaft.

19. The training bat apparatus of claim 15 wherein said visual swing quality indicator is one of a protuberance and a mark formed on said barrel portion of said elongated shaft adjacent to and at a fixed radial position relative to said handgrip portion of said shaft.

20. The training bat apparatus of claim 15 further comprising a knob-shaped weight engaged with said one opposite end of said shaft and being adjustable to change the effect of said weight on the batter.

21. The training bat apparatus of claim 15 further comprising a bristle fiber attachment attached to and extending from said barrel portion at said other opposite end of said shaft to simulate a regulation bat barrel and thus simulate contact of the regulation bat barrel with a pitched ball.

22. A training bat apparatus, comprising:

an elongated shaft having a pair of opposite ends and handgrip and barrel portions disposed in tandem relation to one another along said shaft, said handgrip portion extending from adjacent to one of said opposite ends of said shaft toward the other of said opposite ends thereof, said barrel portion being shorter in length than said handgrip portion and extending from adjacent to said other opposite end of said shaft toward said one opposite end thereof so as to configure said training bat apparatus to be used by a batter for taking a dry swing at a pitched ball;

an audible swing quality indicator being arranged on said elongated shaft so as to produce a noticeable sound in response to said training bat apparatus, when gripped at said handgrip portion of said shaft by a batter, being moved through a dry swing at a pitched ball such that by recognizing what the position of said training bat apparatus is during the dry swing, relative to a given position of simulated ball contact with the pitched ball, when the sound is produced, an indication is provided of the relative quality of the dry swing of the batter in terms of its timing, speed and technique, thereby enabling the batter to undergo effective dry batting training apparatus using the training bat in conjunction with a pitcher and catcher undergoing respective pitching and receiving training in a bullpen session;

a visual swing quality indicator being arranged on said elongated shaft in a given radial position along a longitudinal side, and relative to a longitudinal axis, of said elongated shaft for enabling placement of the hands of a batter in a given proper tandem grip about said handgrip portion of said elongated shaft being in a given proper alignment with said visual swing quality indicator so as to hold said training bat apparatus in a proper pre-pitch launch position at the start of a dry swing of said training bat at the pitched ball such that said visual swing quality indicator is enabled to represent, in accordance with its angular position relative to the playing field, how well the batter has guided said training bat apparatus along a given proper path of dry swing through a position of simulated ball contact thereby enabling the batter to undergo effective dry batting training using said training bat in conjunction with a pitcher and catcher undergoing respective pitching and receiving training in a bullpen session; and at least one mat configured to be deployed adjacent a home plate and having a raised ridge along one edge of said mat opposite another edge of the mat next to the home plate so as to restrict how close a batter can stand to the home plate.

* * * * *

UNITED STATES PATENT AND TRADEMARK OFFICE

CERTIFICATE OF CORRECTION

PATENT NO. : 9,364,734 B1
APPLICATION NO. : 14/121716
DATED : June 14, 2016
INVENTOR(S) : Nicholas E. Dixon, Jr.

It is certified that error appears in the above-identified patent and that said Letters Patent is hereby corrected as shown below:

In the claims

Column 13 (line 53), Claim 1, line 22, delete "its" and insert -- batter --;

Column 14 (line 49), Claim 5, line 22, delete "its" and insert -- batter --;

Column 15 (line 13), Claim 6, line 22, delete "its" and insert -- batter --;

Column 15 (line 47), Claim 7, line 24, delete "its" and insert -- the visual swing quality indicator the --;

Column 16 (line 52), Claim 15, line 22, delete "its" and insert -- batter --;

Column 17 (line 1), Claim 15, line 38, delete "its" and insert -- the visual swing quality indicator the --;

Column 18 (line 30), Claim 22, line 22, delete "its" and insert -- batter --; and Column 18 (line 45), Claim 22, line 38, delete "its" and insert -- the visual swing quality indicator the --.

Signed and Sealed this
Twenty-sixth Day of July, 2016

Michelle K. Lee

Michelle K. Lee
*Director of the United States Patent and Trademark Office*